US008030583B2

(12) United States Patent
Hammer et al.

(10) Patent No.: US 8,030,583 B2
(45) Date of Patent: Oct. 4, 2011

(54) SWITCHING ARRANGEMENT

(75) Inventors: Christian Hammer, Regensburg (DE); Thomas Huber, Regensburg (DE); Albert Schmidbauer, Roding (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 161 days.

(21) Appl. No.: 12/447,550

(22) PCT Filed: Apr. 3, 2008

(86) PCT No.: PCT/EP2008/002633

§ 371 (c)(1), (2), (4) Date: Apr. 28, 2009

(87) PCT Pub. No.: WO2008/138430

PCT Pub. Date: Nov. 20, 2008

(65) Prior Publication Data

US 2010/0059356 A1 Mar. 11, 2010

(30) Foreign Application Priority Data

May 16, 2007 (DE) ..... 10 2007 023 124

(51) Int. Cl.
*H01H 19/00* (2006.01)

(52) U.S. Cl. ..... 200/11 TC; 200/255; 200/260

(58) Field of Classification Search ..... 200/11 TC, 200/252, 254, 255, 260
See application file for complete search history.

(56) References Cited

U.S. PATENT DOCUMENTS

| | | | | |
|---|---|---|---|---|
| 3,396,254 | A | 8/1968 | Bleibtreu | 200/153 |
| 3,415,957 | A | 12/1968 | Bleibtreu | 200/8 |
| 3,739,111 | A * | 6/1973 | Wittenzellner et al. | 200/11 TC |
| 4,356,359 | A * | 10/1982 | Dufrasne et al. | 200/11 TC |
| 4,931,599 | A * | 6/1990 | Bleibtreu | 200/11 B |
| 5,034,578 | A * | 7/1991 | Lauterwald | 200/11 B |
| 6,091,032 | A * | 7/2000 | Dohnal et al. | 200/11 TC |
| 6,849,813 | B1 * | 2/2005 | Albrecht | 200/11 TC |
| 7,497,745 | B2 * | 3/2009 | Baertl et al. | 439/889 |

OTHER PUBLICATIONS

Unknown: "Betriebsanleitung Advanced Retard Switch ARS BA274/01", Jun. 30, 2005, Maschinenfabrik Reinhausen Gmbh, Regensburg, Xp002491826, pp. 1-29.

* cited by examiner

*Primary Examiner* — Xuong Chung Trans
(74) *Attorney, Agent, or Firm* — Andrew Wilford

(57) ABSTRACT

The invention relates to a switching arrangement with two operational settings for switching over a winding during transformer operation, wherein during the switching-over a transient current commutates from one current path to another current path. In that case fixed contacts are arranged in several horizontal planes around a rotatable switching shaft and on an insulating-material frame and have upper and lower contact fingers that can be pressed apart and with which electrical connection can be made by an electrically conductive rail as movable switching contact.

18 Claims, 8 Drawing Sheets

SWITCHING ARRANGEMENT

CROSS REFERENCE TO RELATED APPLICATIONS

Figure 1:
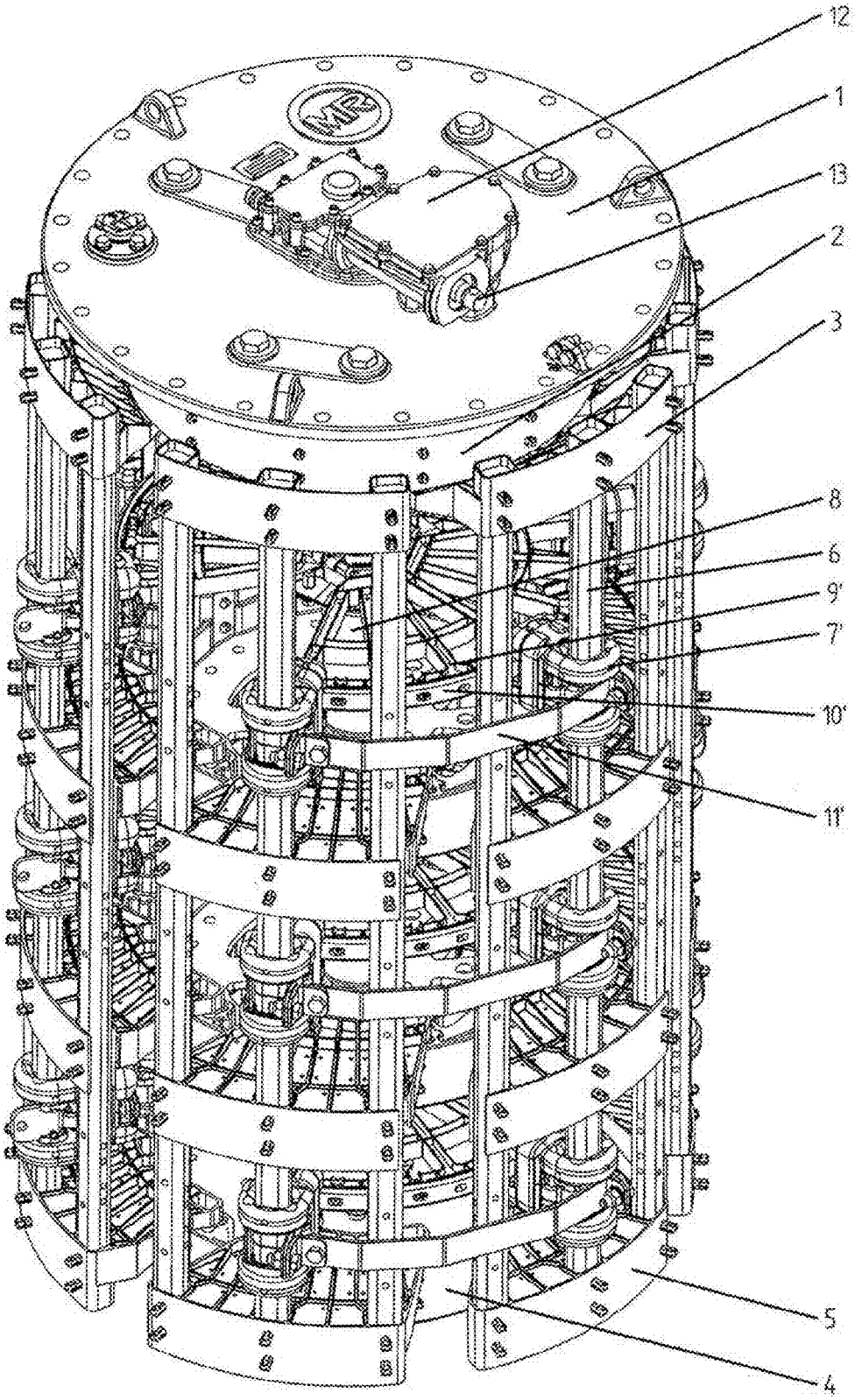

This application is the US national phase of PCT application PCT/EP2008/002633, filed 3 Apr. 2008, published 20 Nov. 2008 as WO2008/138430, and claiming the priority of German patent application 102007023124.7 itself filed 16 May 2007, whose entire disclosures are herewith incorporated by reference.

The invention relates to a switching arrangement with two operational settings for switching over a winding during transformer operation, wherein during the switching-over a transient current commutates from one current path to another current path.

Such a switching arrangement is known under the designation "Advanced Retard Switch" (abbreviated "ARS") from the company publication 'Advanced Retard Switch (ARS), Betriebsanleitung BA 274/01', print number BA 274/01de, 0605, publication date June 2005, of the Applicant. Such a known switching arrangement can be used for different applications in combination with an on-load tap changer. Primarily, it is used for pole reversal of the regulating voltage in applications with a large regulating range, such as, for example, phase-shift transformers. It then executes the function of a double reversing switch.

In this arrangement two horizontal planes are usually provided for each phase to be switched. Fixed contacts are arranged in each plane around a centrally arranged rotatable switching shaft and on an insulating-material frame. Selectable electrical contact with these fixed contacts can be made in each plane by a respective electrically conductive curved switching segment fastened to the switching shaft. Change of the known switching arrangement from one operational setting to the other is effected by rotation of the switching shaft. The change of the operational settings in that case requires a switching step of 120 degrees.

In the known switching arrangement the movable switching shaft has a plurality of contact fingers or plates that are constructed to be movable against the force of contact springs and that ensure that the movable switching segment can reliably run onto the respective fixed contact arranged at the insulating-material frame, even in the case of the small horizontal differences inevitable in production. The contact fingers or plates enable a secure embracing of the respective fixed contact or respective fixed contacts and thus reliable contact-making.

This known switching arrangement has various disadvantages. On the one hand, the movable switching contact, i.e. the switching segment, with its plurality of contact fingers is guided to be movable independently of one another is an extraordinarily complex component with a plurality of individual parts and thus is correspondingly expensive and complicated in production. On the other hand, due to the fact that a plurality of contact fingers of the movable switching contact runs in succession onto the respective fixed contacts, wherein on each occasion spring forces at the respective contact fingers have to be overcome, a high level of torque is required for actuation of the central switching shaft.

The two functional planes usually required for each phase significantly restrict possible construction programs due to the length of the switching arrangement. The geometry of the contact fingers at the switching segment and the fixed contacts, which are to be adapted thereto at the insulating frame, allow only a small volume of the commutating contact. However, this is very much a critical factor for service life.

The object of the invention is to provide a switching arrangement of the known type that no longer has these disadvantages.

This object is attained by a switching arrangement with the features of the first patent claim. The dependent claims relate to particularly advantageous developments of the invention.

According to the invention the movable switching contact, i.e. the curved switching segment, is constructed as a simple curved rail of electrically conductive material. No kind of contact fingers are present, no springs and no guides; the switching segment consists only of a solid rail, preferably a copper rail, the ends of which are tapered so as to facilitate running onto the fixed contacts. This rail can be screw-connected in simple manner with an insulating-material contact support that is in turn fastened to the switching shaft. It is obvious that this represents a quite significant and more economic simplification. Moreover, by virtue of this switching arrangement it is possible to combine the two required functional planes each with four contact places in one plane with six contact places.

In a particularly advantageous development of the invention it is possible to fasten, for example screw-connect, in particular, members of special material that is resistant to erosion burning in a second plane—as seen radially—to the ends of the curved switching segment. This also favors the volume increase, which is required for an extended service life, of the special material resistant to erosion by burning. Moreover, through shifting of the commutating contact to the second plane the copper rail carrying continuous current remains for the major part free, due to the material more resistant to erosion by burning, from contaminations.

According to a further feature of the invention the fixed contacts fastened to the insulating material frame have upper and lower contact fingers that extend parallel to one another and that can be forced apart against the force of the springs, so that the switching segment can run in therebetween and produce an electrical contact.

A particular advantage of the invention is the reduction in parts; all fixed contacts consist for the greatest part of identical components. Moreover, due to the amalgamation, which is possible in a particularly advantageous embodiment of the invention, of the functional planes into a single plane there is in turn a reduction in components. Moreover, in the switching arrangement according to the invention only a significantly lower—compared with the state of the art—level of torque is required for actuation, since when the movable switching segment runs on there are significantly smaller spring forces at the respective contact fingers to be overcome.

Figure 2:
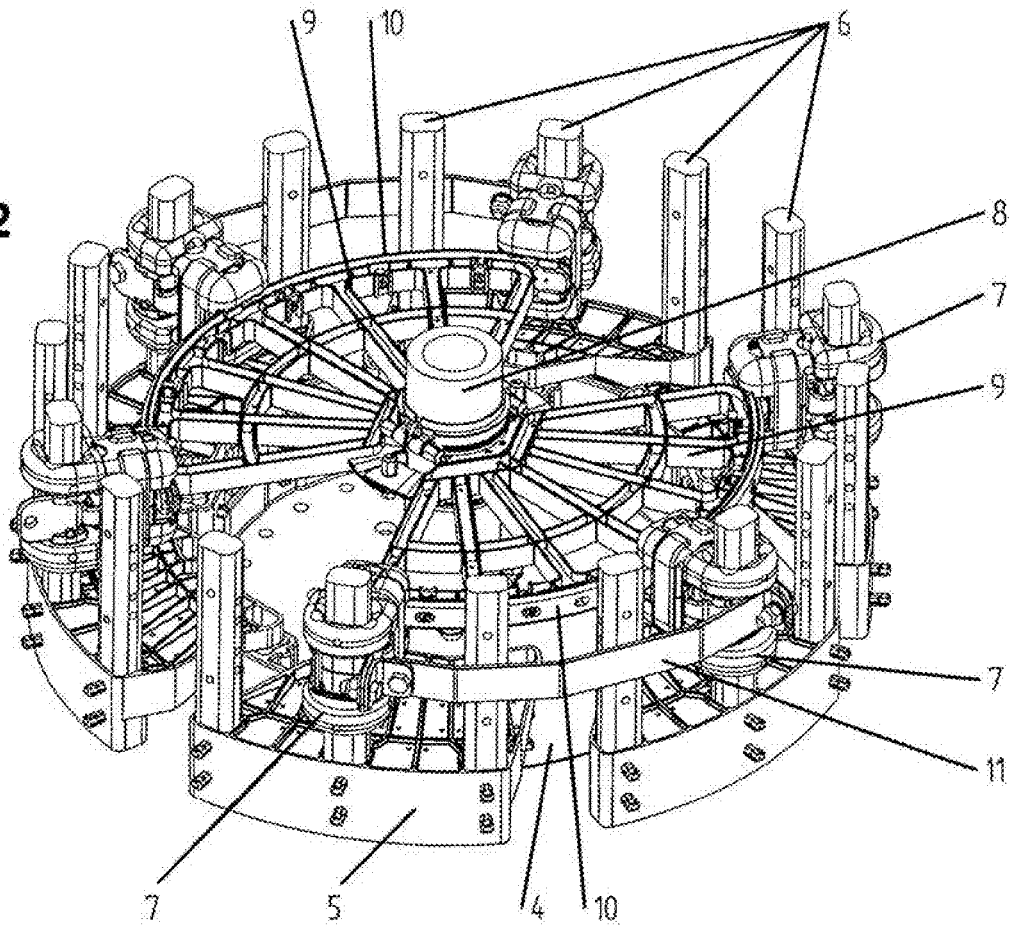
Figure 3:
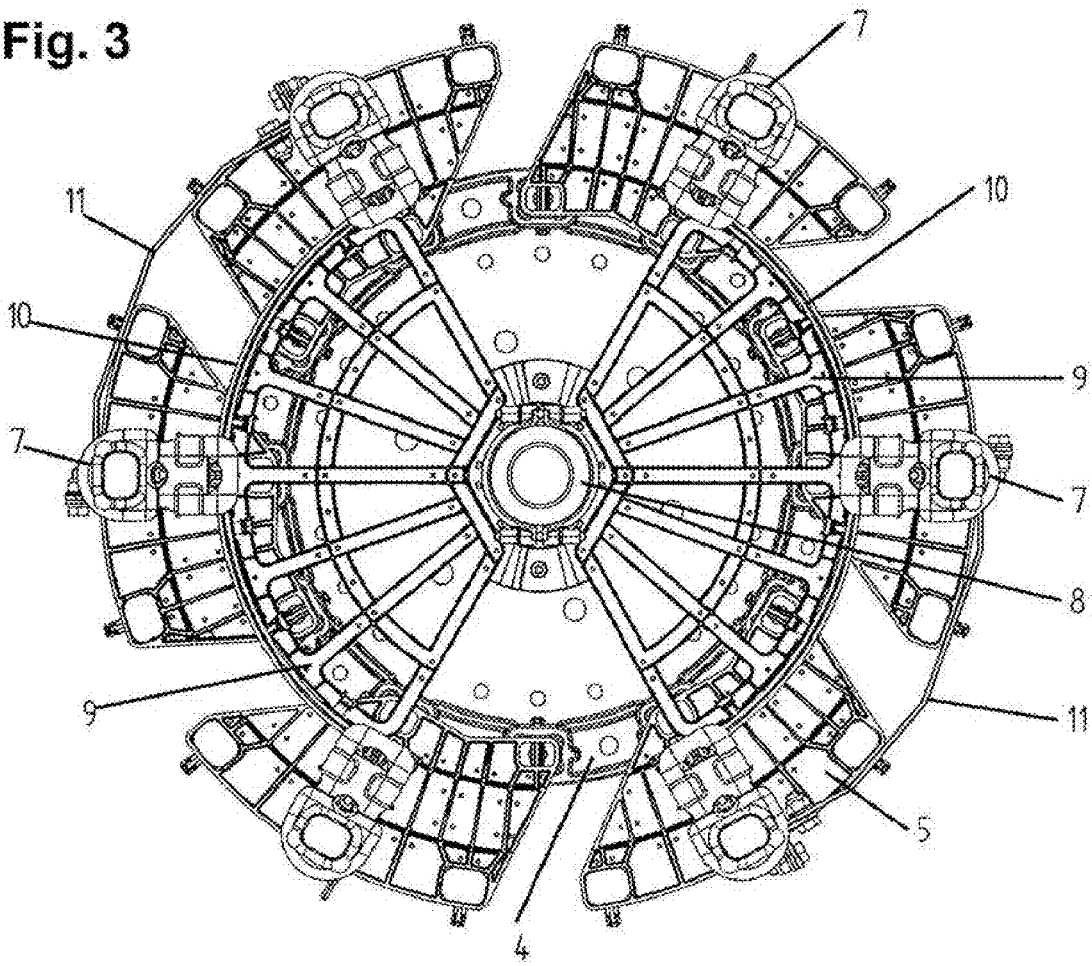
Figure 4:
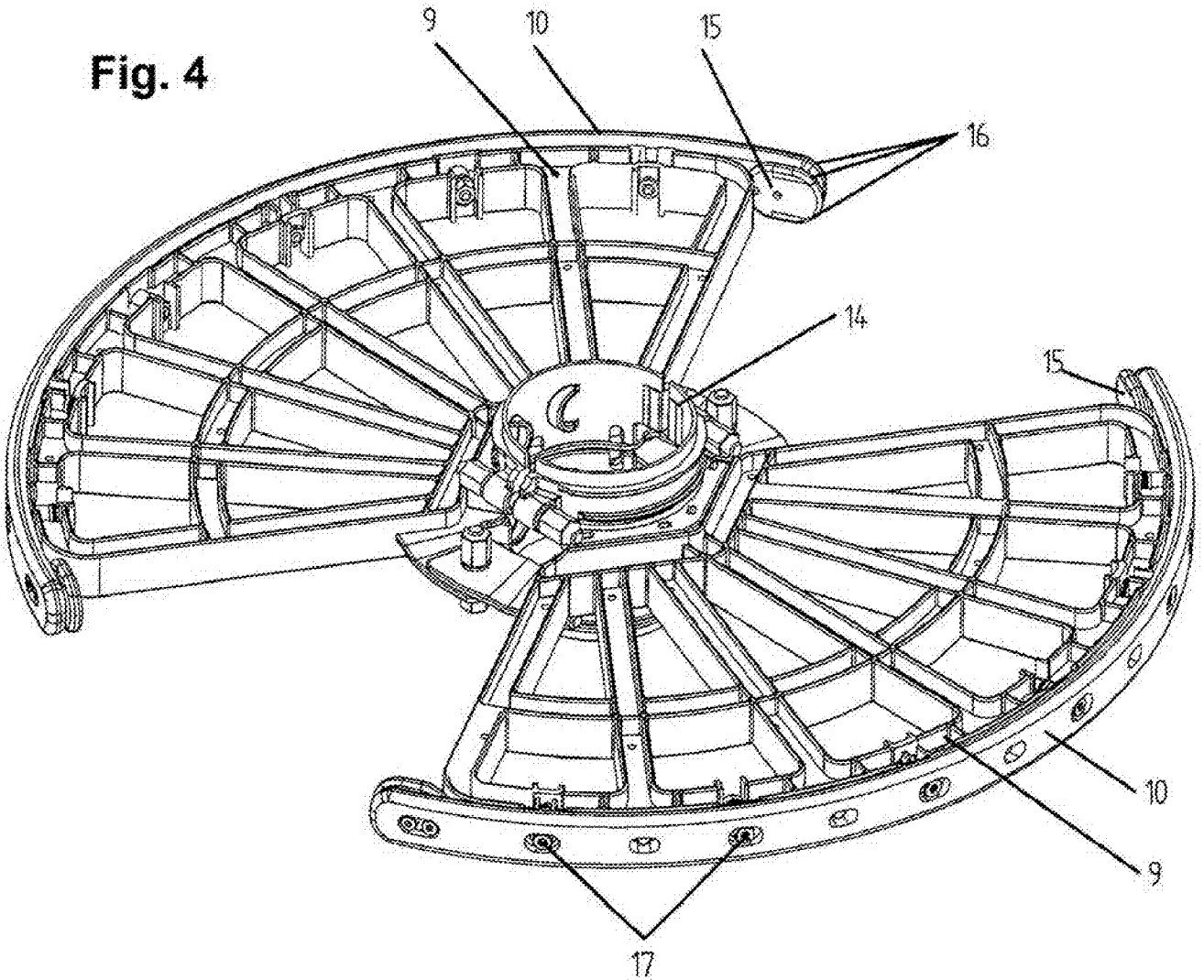
Figure 5:
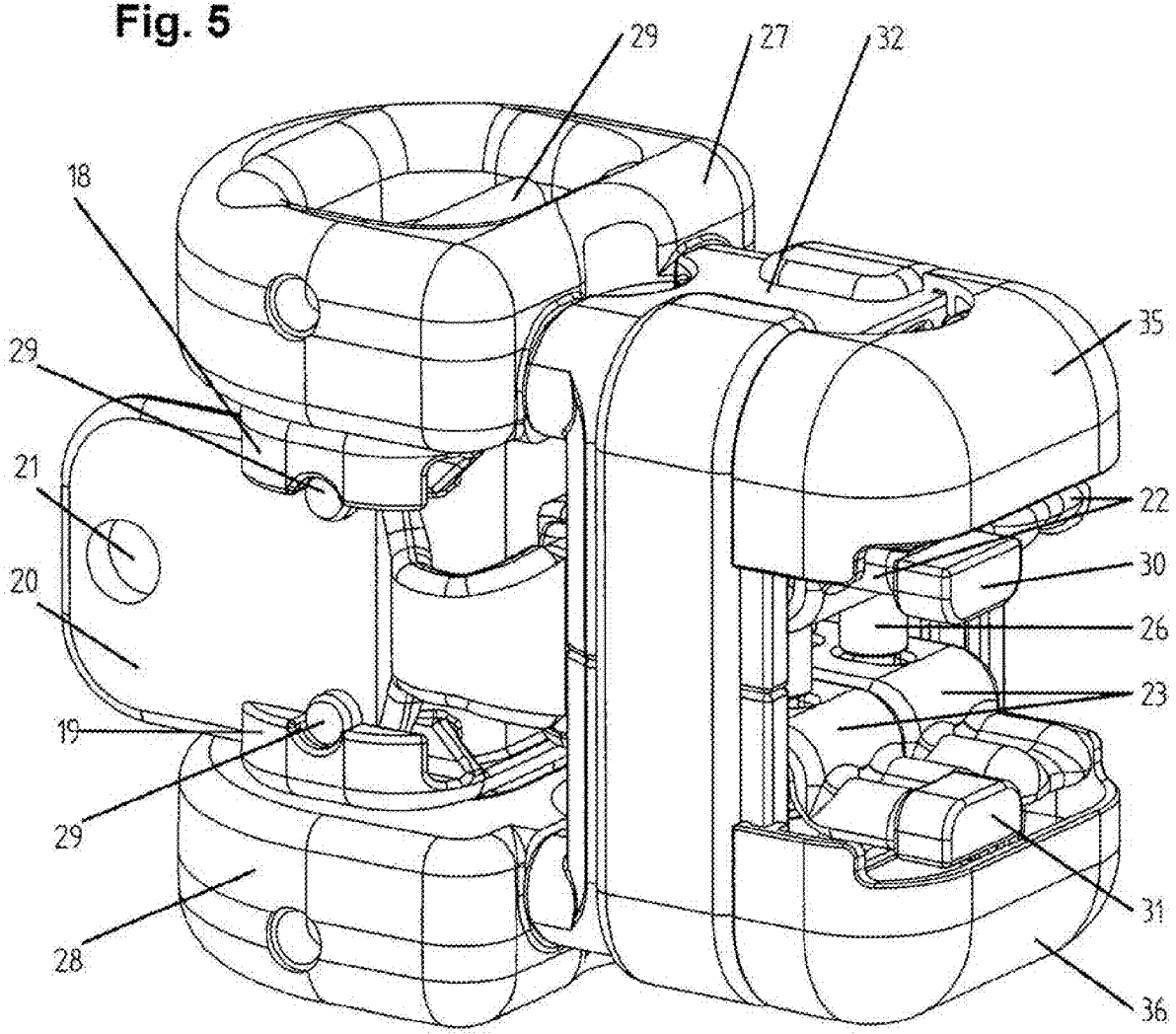
Figure 6:
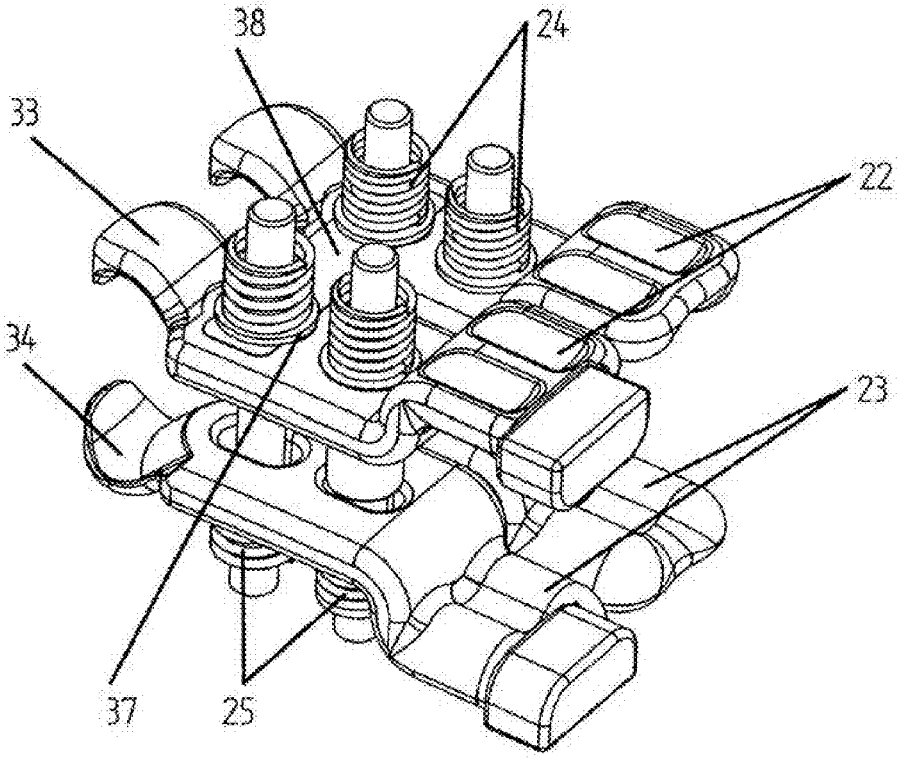
Figure 7:
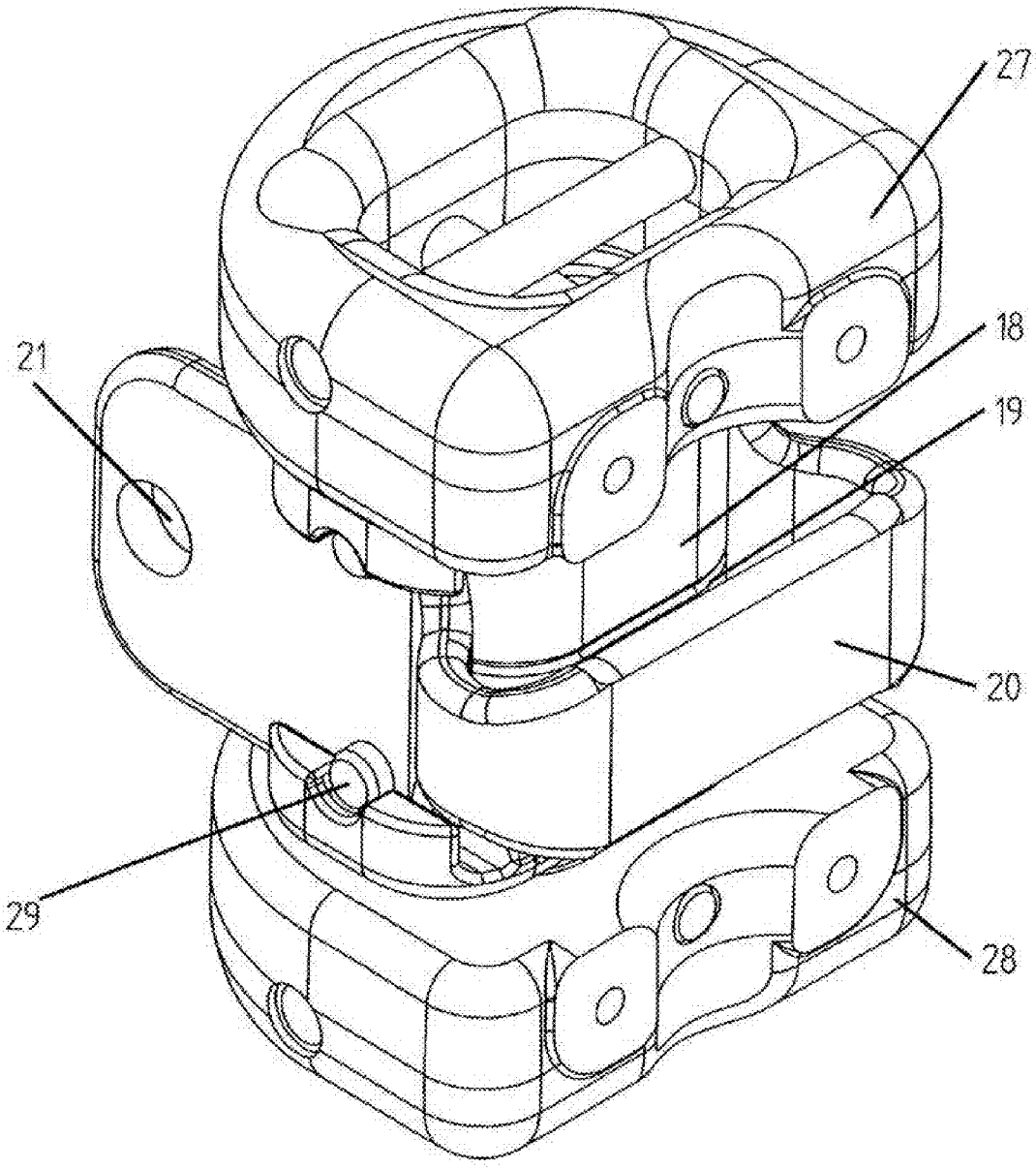
Figure 8:
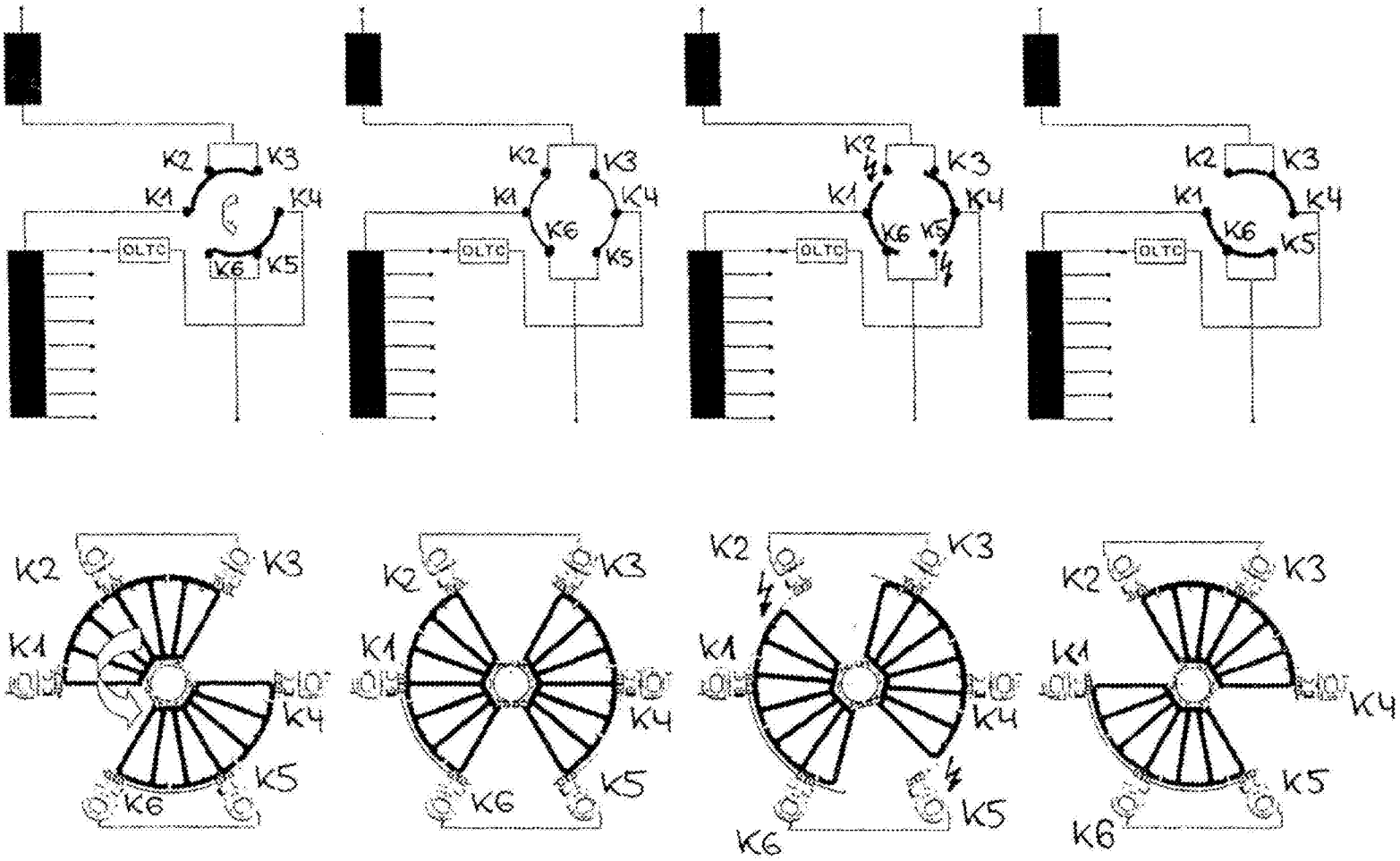

The invention will be explained in more detail by way of example in the following with reference to drawings, in which:

FIG. 1 shows a switching arrangement according to the invention,

FIG. 2 shows a part of this switching arrangement in perspective illustration, FIG. 3 shows this part from above in schematic sectional illustration, FIG. 4 shows a contact finger of the switching arrangement according to the invention by itself, FIG. 5 shows a fixed contact of the switching arrangement according to the invention, FIG. 6 shows a part of such a contact in detail, FIG. 7 shows a fixed contact that can be used in particularly advantageous manner in the switching arrangement according to the invention and FIG. 8 shows a switching sequence, i.e. the switching over of the switching arrangement according to the invention from one stationary operational setting to the other.

In FIG. 1 it is shown that the switching arrangement has at the top a switching head 1 that is known per se and to which an encircling upper cage ring 2 is fastened. An upper adapter 3 is in turn disposed thereat. Provided at the lower end are a lower cage ring 4 and, again fastened thereto, a lower adapter 5. Contact rods 6 arranged to extend vertically and parallel to one another are provided between the upper adapter 3 and lower adapter 5. In the arrangement shown here eighteen such contact rods 16 are fastened so as to be arranged respectively at angles of 20 degrees from one another. Respective fixed contacts 7 are fastened on six of these contact rods 6 in three different horizontal planes; here one plane is provided for each phase to be switched, the number of planes increasing with increasing overall current. The contact rods 6 still free are so-called empty rods that serve for improving the stiffness of the overall arrangement. In FIG. 1 the, in total, six fixed contacts of the first plane are provided with the reference numeral 7', those of the second plane with the reference numeral 7" and those of the third plane with the reference numeral 7'". A vertical switching shaft 8, which has in each plane a contact support 9 fastened thereto, is located centrally in the switching arrangement. Two respective curved switching contacts 10 are fastened, opposite to one another, to this contact support 9 and are thus rotatable together with the switching shaft 8. The connecting bridges 11, provided twice per plane in each instance and fastened opposite one another to each two adjacent fixed contacts, represent a secure electrical contact between the two is fixed contacts. The movable switching contacts 10 extend over an arc of 120 degrees, so that in each phase two bridged and one free adjacent fixed contact 7 are on each occasion simultaneously contacted in the stationary state and thus electrically connected together. The switching shaft 8 is actuated by a Geneva transmission (not illustrated) that is connected with an upper transmission stage 11. The drive thereof is effected by way of a drive shaft 12 that is connected in known manner with a motor drive.

A contact support 9 that is fastened on the switching shaft 8 is shown once again in detail in FIG. 2. In this illustration it can be seen even more clearly that the movable curved switching contacts 10 are respectively fastened to two horizontally opposite sides at the insulating contact support 9. These switching contacts 10 consist of a solid electrically conductive material, preferably copper.

In FIG. 3 lying thereunder, this detail is shown once again in schematic illustration from above. Here it can be seen particularly clearly that in the stationary state in each instance two bridged and one free adjacent fixed contacts 7 are electrically connected together.

FIG. 4 shows once again, in more detailed illustration, a contact support 9 by itself that carries the described solid curved switching contacts 10. Screw-connected with the inner side of the free ends of the switching contacts 10 is, in particular, material 15 resistant to erosion by burning. In addition, the free ends of the switching contacts 10 and the material 15 resistant to burning erosion have a rounding 16 so as to enable better running onto the respective fixed contacts to be electrically connected that are explained in more detail in the following. The entire contact support is fastened to the switching shaft 8 (not shown here) by means of a flange connection 14.

FIG. 5 shows a complete fixed contact 7 of the switching arrangement according to the invention. This contact 7 comprises an upper contact holder 18 and a lower contact holder 19 constructed symmetrically with respect thereto, the two contact holders being pushed over the respective contact rod to which they are to be fastened. Provided therebetween and fixed by the two contact holders 18, 19 is a conductive contact 20 that has a connecting bore 21 for fixing the connecting line (not shown here). This conductive contact 20 is electrically connected with upper contact fingers 22 and lower contact fingers 23 of the actual contact region. The upper contact fingers 22 are deflectable upwardly against the force of the upper contact springs 24 (shown in FIG. 6) and the lower contact fingers 23 downwardly against the force of lower contact springs 25 (again shown in FIG. 6). The respective movable switching contact 10 runs between these contact fingers 22, 23 and thus represents the electrical connection. Through the resilient arrangement of the contact fingers 22, 23, which enclose the movable switching contact 10 at both sides, on the one hand the required contact pressure is produced and on the other hand compensation is provided for the possible slight horizontal tolerances of the overall arrangement. Material 30, 31 resistant to erosion by burning is soldered to the forward end of one of the two contact fingers 22 and 23 and commutates the switching-on current and switching-off current together with the material 15, which is resistant to erosion by burning, at the switching contact 10. The position of the contact fingers 22, 23 with the material 30, 31 resistant to erosion burning, whether arranged on the left or the right in the contact housing 32, is dependent on the position in the switching arrangement. Counter-bearings 26 are, in addition, disposed between the contact fingers 22, 23. In addition, an upper screen 27 and a lower screen 28 are respectively pushed onto the contact arrangement at the top and the bottom, the screens respectively having in the center thereof corresponding openings allowing pushing onto the respective contact rod. Bolts 29 that fix the contact holders 18, 19 or screens 27, 28 on the contact rods by way of bores are, in addition, shown. The screens 35, 36, which are mounted at the contact housing 32, screen the contact fingers 22, 23 and materials 30, 31 resistant to burning erosion and thus serve for improved electrical field formation. This part of a similar fixed contact with contact holders, screens as well as bores, through which the fastening bolts are pushed, is already known from DE 10 2004 041 317 B3.

A detail of the fixed contact according to the invention is shown by itself once again in FIG. 6. It is illustrated here that the upper contact finger 22 and the lower contact finger 23, together with the contact springs 24, 25, are arranged in a separate contact housing 32, which is not shown here. These contact fingers 22, 23 have, at the opposite side, contact clips 33 and 34 that according to a particularly advantageous development of the invention clip around the fixed contact 20 on both sides and thus produce a direct electrical connection. The upper current band 38 lying between the contact fingers 22 and the washers 37 and lower current band 38 lying between the contact fingers 23 and the washers 37 (not visible here) help avoid commutation between the contact fingers 22, 23 and the conductive contact 20 due to rebounds during switching on and switching off the switching contact 10.

FIG. 7 shows, once again, a fixed contact by itself. In this case through simple clipping of the contact clips 33, 34 onto the conductive contact 20 it is possible in simple manner to make the fixed contact according to the invention, thus as shown in FIG. 5, modular, i.e. in accordance with the building block system.

Finally, switching over of the switching arrangement according to the invention from one operational setting to the other is shown in FIG. 8. The respective electrical circuit is schematically illustrated in the upper part and the corresponding setting of contact support and movable switching contacts of a phase relative to the fixed contacts is shown in the lower part. The six fixed contacts in a phase are here denoted by K1 . . . K6. The lefthand illustration shows the first stationary operational setting; the rotational direction at the beginning of switching over is marked each time by an arrow. In the arrangement alongside on the right the switching contacts have each covered a rotational angle of 60 degrees. In turn, in the next illustration on the right the rotational angle amounts to somewhat more than 60 degrees and the transient current commutates to the other switching branch; this is indicated by the symbolized flash. In the illustration entirely on the right the new stationary operational setting is reached after in total 120 degrees of rotational angle. The switching-over is thus concluded and a new switching-over takes place in accordance with the function of a double reversing switch explained in the introduction.

The invention claimed is:

1. A switching arrangement with two operational settings for switching over a winding during transformer operation, wherein during the switching-over a transient current commutates from one current path to another current path, wherein at least one horizontal plane is provided for each phase to be switched, wherein in each horizontal plane fixed contacts are arranged around a centrally and vertical rotatable switching shaft and on a common insulating-material frame and wherein selectable electrical connection with the fixed contacts in each plane can be made by at least one respective movable switching contact fastened on the switching shaft, characterized in that the movable switching contact is constructed as a curved horizontally extending rail of electrically conductive material and that the fixed contacts have upper and lower contact fingers that extend parallel to one another and that can be pressed apart against the force of upper and lower contact springs in such a manner that the movable switching contact can run in therebetween and produce an electrical contact.

2. The switching arrangement according to claim 1, characterized in that the movable switching contact consists of a solid rail of copper.

3. The switching arrangement according to claim 1 or 2, characterized in that the ends of the rail are narrowed.

4. The switching arrangement according to any one of claim 1 to 3, characterized in that the movable switching contact is fastened to a contact support that in turn is fixedly connected with the switching shaft, of insulating material.

5. The switching arrangement according any of claim 1 to 4, characterized in that material resistant to erosion by burning is fastened to the ends of the movable switching contact.

6. The switching arrangement according to claim 5, characterized in that the material resistant to erosion by burning is fastened in a second plane as seen radially.

7. The switching arrangement according to any one of claim 1 to 6, characterized in that the fixed contact has an upper contact holder and a lower contact holder formed symmetrically thereto and that a conductive contact is provided between the two contact holders and fixed by these.

8. The switching arrangement according to any one of claim 1 to 7, characterized in that at least one contact finger of material resistant to erosion by burning is arranged at the front end.

9. The switching arrangement according to any one of claim 1 to 8, characterized in that an upper screen and a lower screen are pushed onto the complete fixed contact respectively at the top and bottom and that the contact holders as well as the screens are fixed to the insulating-material frame by means of bolts.

10. A switching arrangement comprising:

a dielectric housing centered on an upright axis;

a plurality of contact arrays lying on respective axially spaced planes extending perpendicular to the axis and each having an upper row of fixed contacts and a lower row of fixed contacts;

a shaft extending on the axis in the housing and rotatable about the axis;

respective curved horizontally extending and electrically conductive contact rails carried on and rotatable with the shaft and each engaged between the rows of fixed contacts of a respective contact array; and respective springs braced against the fixed contacts and biasing the upper contacts downward and the lower contacts upward, whereby as the shaft rotates the contacts rails slide between, push axially apart, and make electrical contact between selected upper contacts and the respective lower contacts.

11. The switching arrangement defined in claim 10 wherein the rails are of solid copper.

12. The switching arrangement defined in claim 10 wherein the rails have tapered angularly opposite ends.

13. The switching arrangement defined in claim 10, further comprising:

respective dielectric contact supports having inner ends anchored on the shaft and outer ends carrying the contact rails.

14. The switching arrangement defined in claim 10, further comprising erosion-resistant bodies secured to ends of the contact rails.

15. The switching arrangement defined in claim 14 wherein the bodies are offset radially from the respective rails.

16. The switching arrangement defined in claim 10, further comprising respective contact holders fixed on the housing and each holding one of the upper fixed contacts and the respective lower fixed contact.

17. The switching arrangement defined in claim 10, further comprising respective bodies of erosion-resistant material on radial inner ends of the fixed contacts.

18. The switching arrangement defined in claim 10, further comprising a respective upper shield above each of the upper fixed contacts; and a respective lower shield below each of the lower fixed contacts.

* * * * *